United States Patent [19]

Young

[11] 4,183,516

[45] Jan. 15, 1980

[54] BLANK FEEDING APPARATUS

[75] Inventor: Jerry W. Young, Weston, Mo.

[73] Assignee: Phillips Petroleum Company, Bartlesville, Okla.

[21] Appl. No.: 798,044

[22] Filed: May 18, 1977

[51] Int. Cl.[2] ..... B65H 5/22

[52] U.S. Cl. ..... 271/3.1; 271/10; 271/113; 271/119; 271/126; 271/159

[58] Field of Search ..... 271/10, 113, 119, 126, 271/157–159, 3.1

[56] References Cited

U.S. PATENT DOCUMENTS

| | | | |
|---|---|---|---|
| 2,705,636 | 4/1955 | LaBombard | 271/36 |
| 3,506,258 | 4/1970 | Lindquist | 271/41 |
| 3,866,903 | 2/1975 | Eppe | 271/119 |
| 3,908,982 | 9/1975 | Abe | 271/21 |
| 3,998,448 | 12/1976 | Gray | 271/159 X |
| 4,052,051 | 10/1977 | Mersereau | 271/159 X |

OTHER PUBLICATIONS

IBM Technical Disclosure Bulletin, vol. 17, No. 6, p. 1549, Nov. 1974, "Envelope Loading Module", R. E. Hunt and W. M. Jenkins.

*Primary Examiner*—Richard A. Schacher

[57] ABSTRACT

An apparatus is provided for individually feeding blanks from a source of blanks to a point of use. The apparatus includes a feeding apparatus which has a portion thereof engageable with a side wall blank contained in the stack and feed same onto a conveyor and then to a second transfer mechanism which conveys the side wall blank to a point of use. The feeding apparatus is comprised of a mechanism which basically is comprised of a four-link arm arrangement wherein a throat-forming member is maintained in a substantially vertical plane throughout pivoting movement of the arm arrangement thereby maintaining a side wall blank in a feed position. An elevator means is also provided which has a storage magazine and is positioned below the feeding apparatus. The elevator means includes a pair of elevators which work jointly so the elevator means can be reloaded while the feeding apparatus is still running without requiring a shutdown of the equipment to fill the magazine.

22 Claims, 9 Drawing Figures

BLANK FEEDING APPARATUS

Many devices are known for individually feeding sheets or blanks of material from a source to the point of use and are of several types such as the type which feeds from the bottom of a stack, the type which feeds from a horizontal stack and the type which feeds from the top of a stack of sheets. One of the problems with such devices is the maintenance of a substantially equal pressure between the sheets and the feeding apparatus. In a vertical stack bottom feed type of device this is of particular importance in that the lower the stack becomes the less pressure is applied resulting in a wide variation in pressure. However, this type of feeder has advantages in that it is easy to load the storage magazine during operation without requiring shutdown of the feeder mechanism. The type of apparatus which feeds from the top of the stack has the difficulty of not maintaining a relatively constant pressure applied by the feeding mechanism to the sheets to be fed. Also, there is the problem of maintaining an adequate supply of sheets available without requiring a cessation of operation of the feeder to reload a storage magazine. In the horizontal stack type of apparatus, the plane of the sheets fed is usually changed before same can be used. This requires complicated mechanisms and on thicker sheets is undesirable in that a curl could be formed in the sheet. Feeding apparatuses must operate efficiently with a minimum of missed feeds when operated at high speeds as, for example, the feeding of 60 sheets per minute. Also, only one sheet can be fed at a time so as to prevent the formation of a bad part which is made from the sheet. The present invention provides a positive feed apparatus and a magazine which is adapted for feeding from the top of a stack while still providing an easy to fill magazine which does not require termination of operation of the feeding apparatus in order to fill the magazine.

The present invention overcomes the above-described difficulties and provides a feeder mechanism and elevator which provides improved operating results.

The principal objects and advantages of the present invention are: to provide an apparatus which positively feeds a sheet or blank from a stack to a point of use; to provide such an apparatus with elevator means wherein a sheet is fed from the top of a stack; to provide such an apparatus wherein operation termination is not required in order to fill a sheet storage magazine; to provide such an apparatus wherein a sheet-receiving throat forming means maintains substantially the same angular position throughout the movement thereof; and to provide such an apparatus which is well adapted for its intended use.

Other objects and advantages of the present invention will become apparent from the following detailed description taken in connection with the accompanying drawings wherein are set forth by way of illustration and example certain embodiments of this invention.

Figure 1:
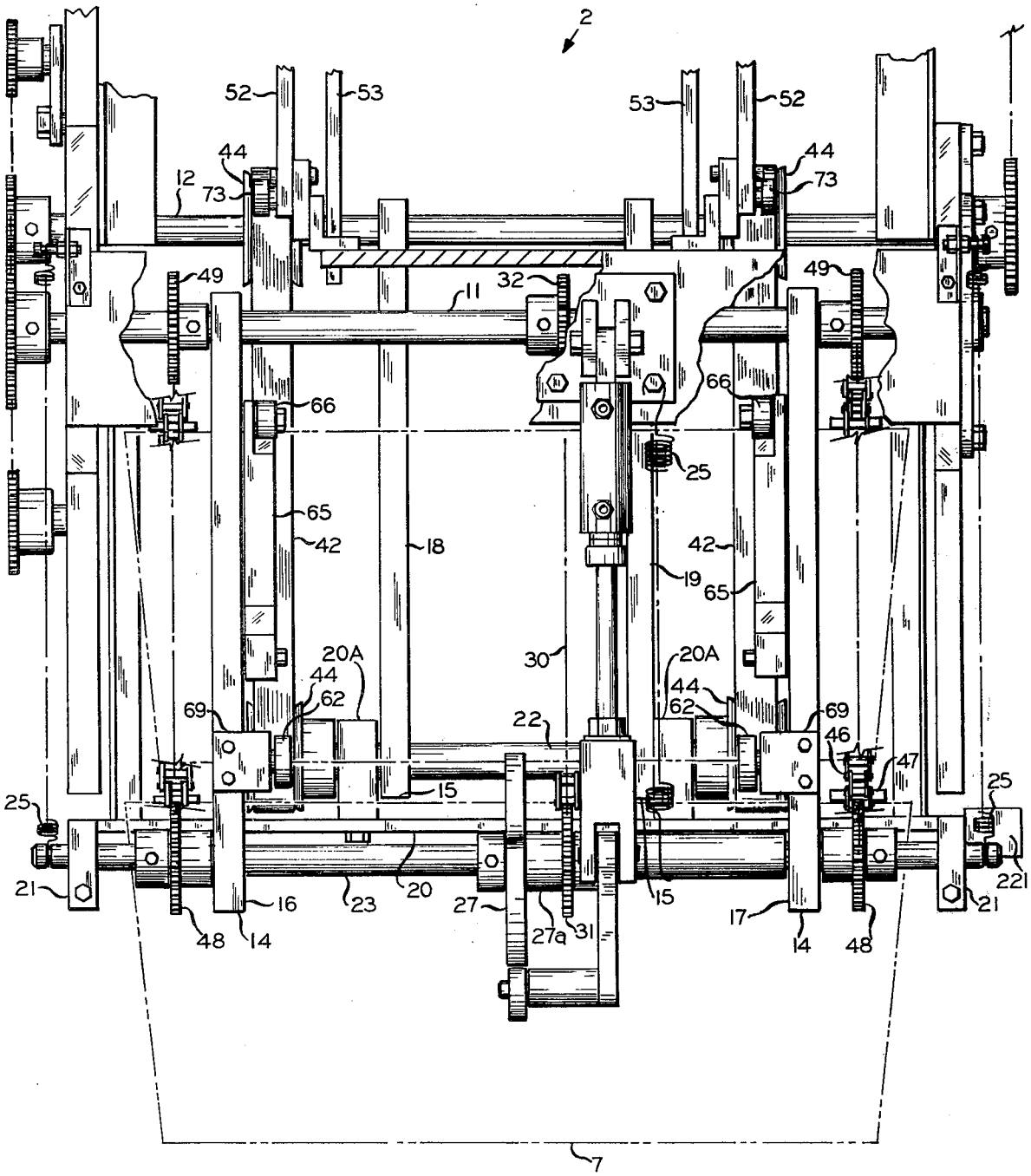
FIG. 1 is a fragmentary plan view of a portion of the feeder mechanism.

Referring more in detail to the drawings:

The reference numeral 1 designates generally an apparatus for supplying and feeding sheets of material to a point of use. The apparatus 1 includes a feeding means 2 and a storage magazine 3 operable to supply sheets to the feeding means 2. The apparatus 1 is particularly well adapted for use in combination with a container-forming machine (not shown), however, it is to be understood that same is equally well adapted for use with any apparatus which feeds individually fed sheets of material supplied thereto (see FIG. 5).

The feeding means 1 includes a support 5 of any suitable type and can be a portion of or secured to a portion of the machine (not shown) which uses the sheets fed thereto. The feeding means 2 includes a means 6 for individually removing a blank 7 from a stack 8 thereof (see FIG. 3). In the illustrated structure the feed means 2 includes first and second arm means 9 and 10, respectively, which are pivotally mounted on the support 5 in any suitable manner as, for example, by the first arm means being pivotally mounted on a shaft 11 and the second arm means being pivotally mounted on a shaft 12. Preferably the shafts 11 and 12 are rotatably mounted on the support 5. The arm means 9 and 10 extend in a generally horizontal plane and have ends 14 and 15 pivotably mounted on shafts 23 and 22, respectively. Although other arrangements are feasible, the illustrated structure shows that each of the arm means is comprised of a spaced apart pair of arms wherein the first arm means 9 includes arms 16 and 17 and the second arm means 10 includes arms 18 and 19. The pivotal mounting can be by any suitable means and, as shown, the shaft 22 is rotatable within the arms 18 and 19 and the arms 16 and 17 are rotatable about fixed shaft 23. A throat-supporting member 20 is also pivotally mounted on shaft 22 by connecting members 20A. The member 20, which as shown, includes the connecting members 20A and end plates 21, form a rigid link between the first and second arm means 9 and 10 whereby the first and second arm means 9 and 10, member 20 and support 5, form a four bar linkage arrangement which has the components thereof movable relative to one another. Counterbalance means is provided to help support the weight of the first and second arm means 9 and 10 and the parts carried thereby to reduce the downward force applied by same to the stack 8. Any suitable means can be provided and, as shown, a plurality of springs 25 extend between a portion of the support 5 and the first and second arm means 9 and 10.

Figure 3:
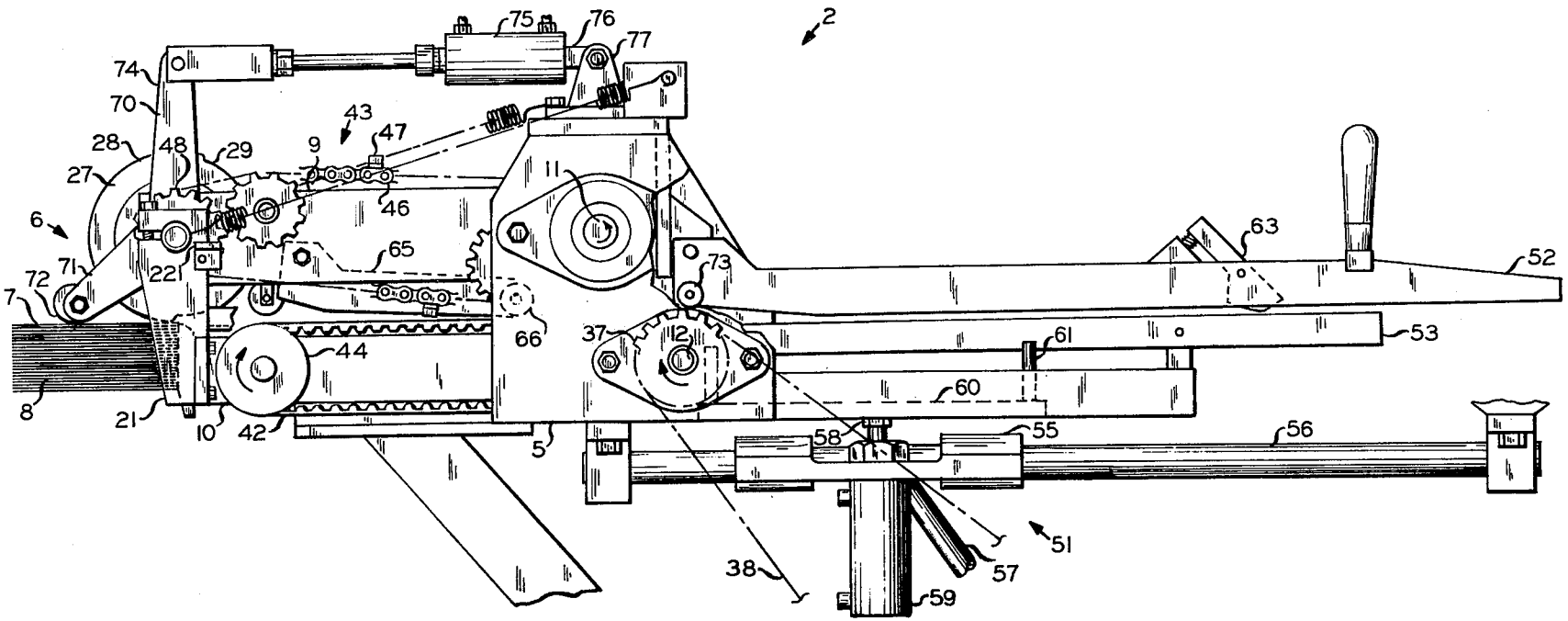
FIG. 3 is a side elevational fragmentary view of the feed means.

The feeding means 2, as shown, includes a rotatable friction member 27 which preferably is suitably mounted on the shaft 23 and is shown as a wheel which has a peripheral friction surface 28 which is engageable with a blank 7 for selectively feeding same to portions of conveying means described below. As is known in the art, the friction member 27 is provided with a recessed or reduced diametral portion 29 wherein the spacing between the enlarged diametral portion and the reduced diametral portion is preferably slightly greater than the thickness of one blank whereby the friction member 27 can be continually rotated while selectively and sequentially feeding a blank to portions of the conveying means. The friction member 27 is attached to a hub 27A and sprocket 31 for rotation about the nonrotatable shaft 23 and operably connectd to a drive means for effecting rotation of the friction member 27. In the illustrated structure the chain and sprocket drive arrangement is provided to positively drive the friction member 27 synchronously with other portions of the apparatus 1. The chain 30 is operably engaged with sprockets 31 and 32 and the sprocket 32 is rigidly mounted on the shaft 11 or rotation with the shaft 11. Preferably, the shaft 11 is driven by a sprocket 34 connected by a chain 36 to a sprocket 35 and since rotation of the shaft 11 should be synchronized with rotation of various other portions of the apparatus as described hereinbelow, a chain and sprocket drive arrangement connects the shaft 11 to the main drive via the shaft 12. A sprocket 37 is also mounted on the opposite end of shaft 12, as best seen in FIG. 3 and a chain 38 connects the sprocket 37 to a main drive (not shown).

Figure 2:
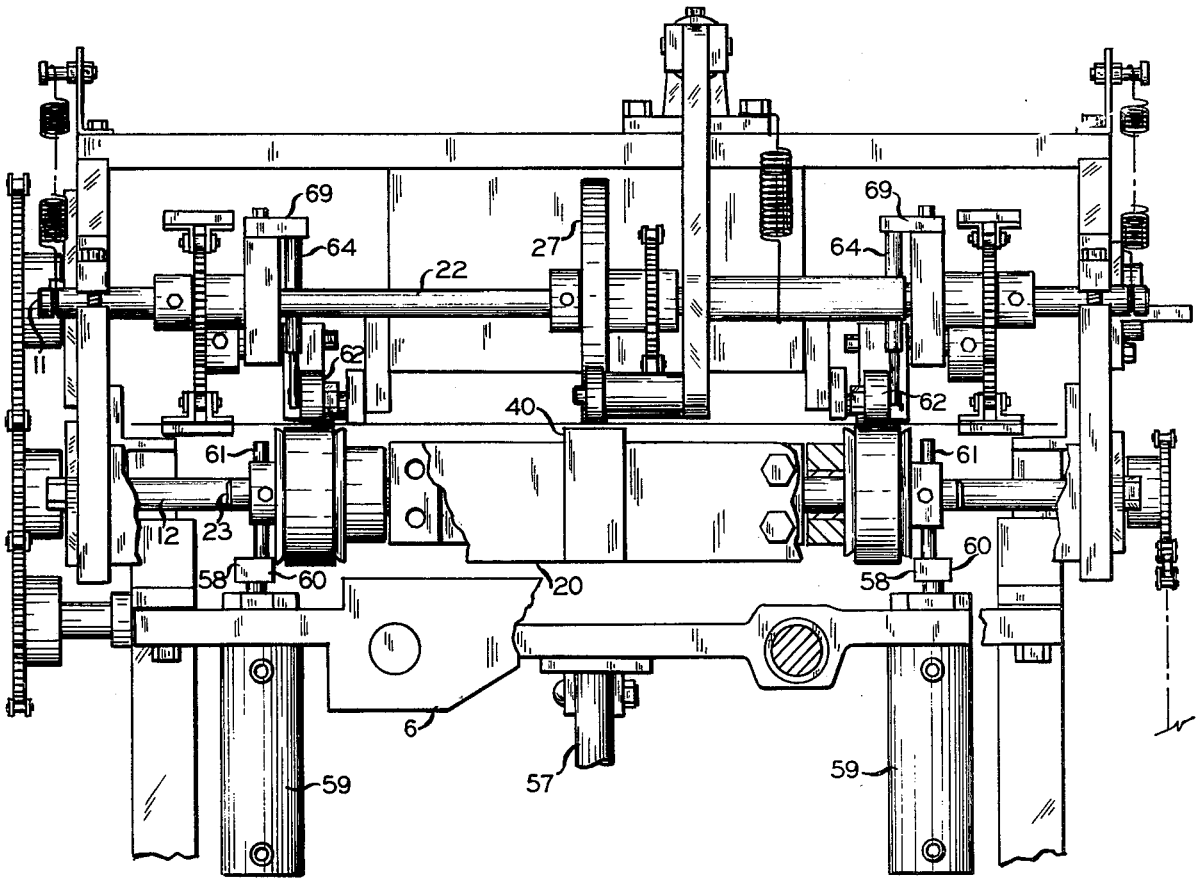
FIG. 2 is an end view of the feeder mechanism as seen from the feed end thereof.

As shown, the member 20 has a throat-forming member or portion 40 thereon and preferably projects above an upper edge of the member 20 as best seen in FIG. 2 and is spaced from the large diametral portion of the friction member 27 a distance substantially equal to the thickness of one blank 7 so that only one blank can be fed through a throat formed between the wheel 27 and the member 40. Because a four-link linkage arrangement is formed between the first and second arm means 9 and 10, the member 20 and the support 5, the angular position of the member 20 and hence the portion 40 thereof, remain in substantially the same angular position relative to a fixed plane throughout pivoting movement of the first and second arm means 9 and 10 and the member 20. This will occur if the shafts 11 and 12, 22 and 23 are positioned to form a parallelogram of the arm means 9 and 10, member 20 and support 5 which is the preferred embodiment of this invention. Preferably the portion 40 travels in a generally vertical plane throughout the pivoting movement of the first and second arm means 9 and 10. Such movement helps prevent missed feeds of the blanks 7. It is to be noted, however, that the portion 40 will move slightly in a horizontal plane relative to the stack 8 during pivoting movement of the first and second arm means 9 and 10. However, it has been found that this slight horizontal movement is not detrimental to the feeding efficiency of the apparatus.

The blank 7 after being fed through the throat is picked up by conveying means to transfer same to a point of use from the stack or source of blanks. In the form shown, the conveying means includes at least one friction conveying member 42 and a positive drive means 43. As shown in FIG. 1, there are a plurality of friction members 42, which can be flexible rubber belts, each operably connected to a respective pair of pulleys 44. Preferably, the pulleys 44 include two pulleys rigidly mounted on the shaft 12 to be driven thereby and two pulleys rigidly mounted to rotate with the shaft 22. The pick-up or infeed end of the belts 42 is positioned adjacent the throat member 40. The positive drive means 43, as shown, includes a pair of chains 46 each having a plurality of abutments or dogs 47 secured thereto in spaced apart relation with the spacing between the abutments 47 being greater than the width of a blank 7 at the point of contact therewith. Preferably, the chains 46 are driven by shaft 11 at a speed less than the speed of the belts 42 whereby frictional engagement of the belts 42 with a blank 7 urges the leading edge of the blanks 7 into engagement with a leading abutment 47 to retain the blanks in a proper indexed position. Pairs of sprockets 48 and 49 each have a respective chain operably engaged therewith wherein preferably the sprockets 49 are rotatable about the shaft 23 and the sprockets 49 are secured to the shaft 11 and are driven thereby. This synchronizes the friction member 27 with the movement of the abutments 47 to assure proper feeding of the blanks 7.

Figure 5:
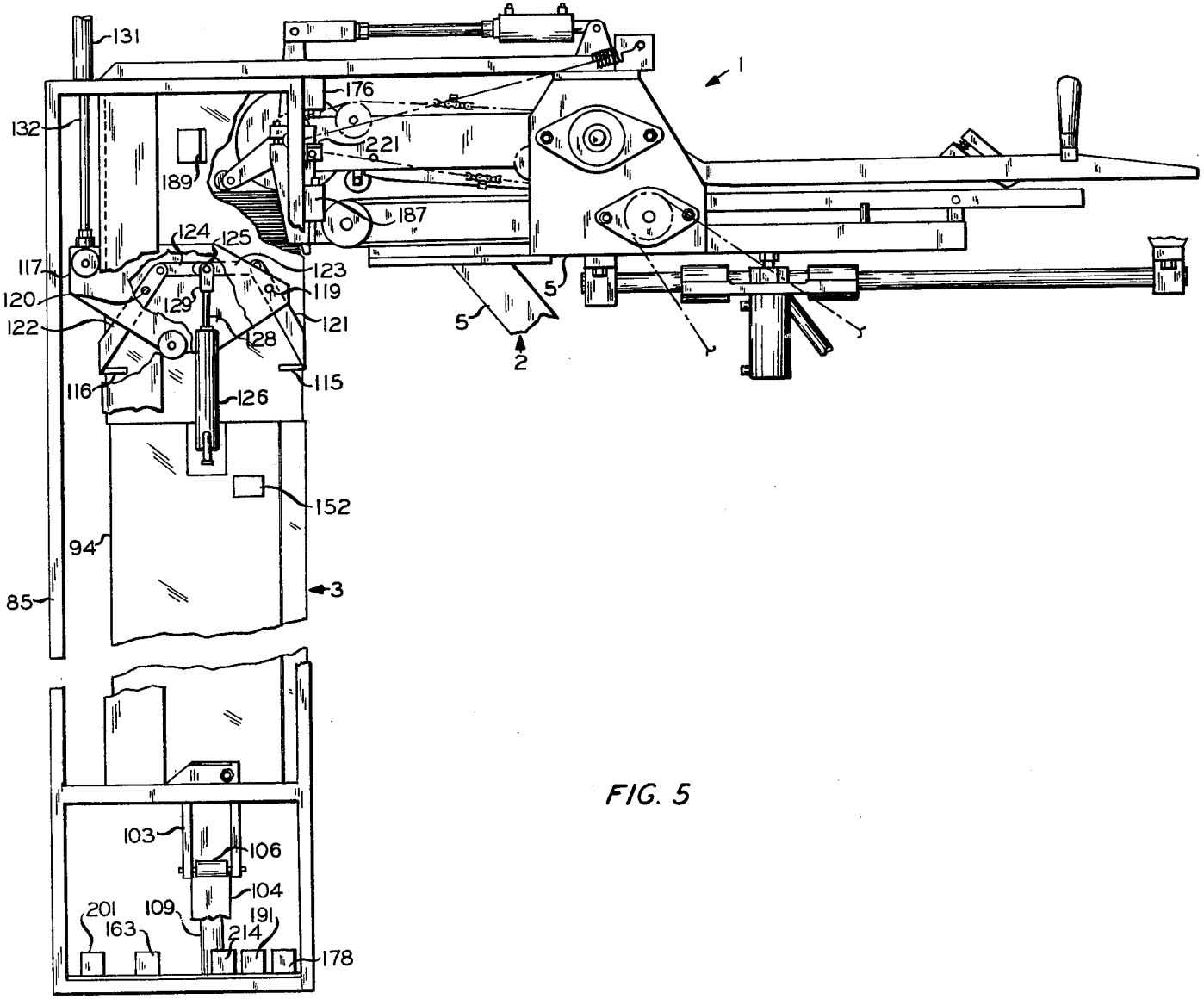
FIG. 5 is a side elevation view of the feed apparatus and a storage magazine.

Preferably, there is a second portion of the conveying means which will receive a blank 7 from the chain and belt arrangement described above for further conveying of the side wall blank. After discharge from the first portion of the conveying means a second conveying means 51 receives the blank 7 and feeds same to a point of use as, for example, a container-forming apparatus. The conveying means 51 should accurately position the side wall blank 7 and retain same in a predetermined position so that the end use apparatus (not shown) can pick same up from an accurately determined position whereby the blank can be properly processed for an end use. In the illustrated structure, the conveying means 51 includes means forming a blank guide whereby the blank is held in a predetermined (as shown) horizontal position. The guide means as shown includes spaced apart bars 52 and 53 with two spaced apart pairs of the bars being provided for supporting opposite sides of the blank 7. The blank 7 rests on the bars 53 and upward movement of the blank is prohibited or prevented by the bars 52. A carriage 55 is movably mounted on guides 56 for longitudinal reciprocal movement. The guides 56 are supported on the frame of the machine with the carriage being operably connected to the main drive (not shown) by an arm 57 so that the carriage 55 can be moved synchronously with the first portion of the conveying means described above. As best seen in FIGS. 3 and 5, movement to the right of the carriage 55 will move a side wall blank toward a point of use. The conveying means 51 also includes a reciprocally mounted transfer mechanism 58 which is mounted on the carriage 55 for movement therewith. The transfer mechanism has means for moving same generally normal to the direction of travel of the carriage 55 (vertically as seen in FIG. 3) and as shown this means includes an extendable and retractable ram 59 mounted on the carriage 55. A support 60 is secured to the ram 59 and has a pair of spaced apart upstanding fingers 61 secured thereto. During forward or feeding movement of the carriage 55 the ram 59 is extended from the position shown in FIG. 3 whereby the fingers 61 engage the blank 7 and the carriage 55 moves the sidewall 7 held between bars 52 and 53 to the point of use. As seen in FIG. 2, there is a pair of the transfer mechanisms 58 each positioned on an opposite side of the feeding means 2 so that the fingers 61 will engage opposite ends of the blanks 7. During feeding or forward movement of the carriage 55, the blank is fed to a position for use while being accurately positioned by the fingers 61 and the bars 52 and 53. After the fed side wall blank is picked up by another portion of a using apparatus the fingers 61 are moved to a retracted or down position and the carriage 55 is then retracted or moved back to a start position whereby the transfer mechanisms are ready to be extended to pick up another side wall blank 7 for feeding.

Figure 4:
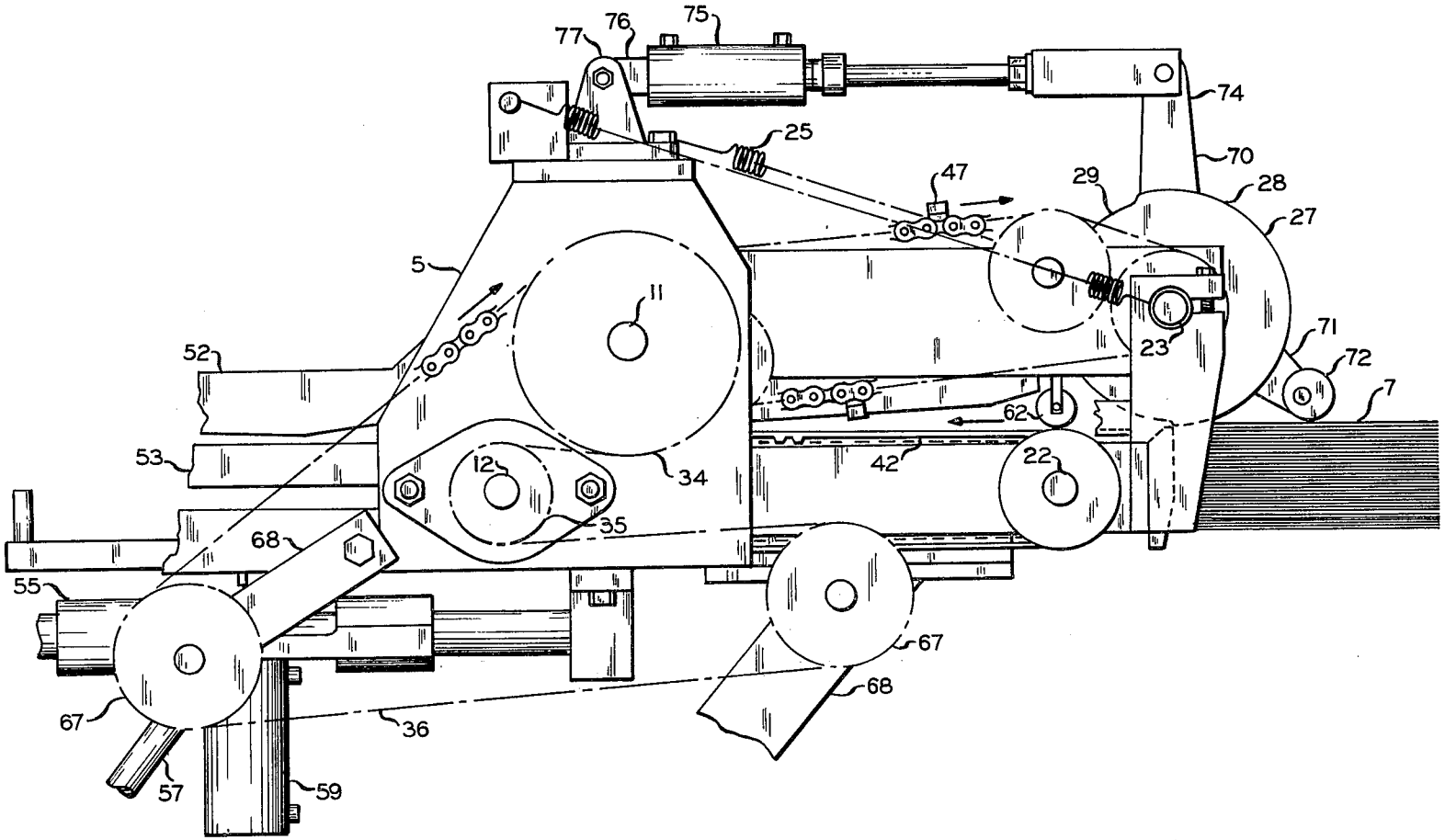
FIG. 4 is a fragmentary side elevation view of the feed apparatus as seen from the opposite side of FIG. 3.

Preferably, and as shown, a suitable brake 63 which is pivotally mounted on the bar 52 is positioned relative to a side wall blank 7 passing thereunder to prevent the blank 7 from moving backward when it is being picked up by the using machines. Such brakes are known in the art and need not be further described herein. Also, the first conveying means is provided with hold-down apparatus which will prevent a blank 7 from moving out of frictional engagement with the belts 42. This is best seen in FIGS. 1 and 2. As friction member 27 first moves a sidewall blank 7 forward, it engages belts 42 between the lower surface of rollers 62 and the upper surface of belt 42. Rollers 62 are preferably biased downward such as by a spring (not shown) inside tubes 64 supported by bracket 69 attached to the top of arms 17. A weighted pivot arm 65 is pivotally mounted on each of the arms 16 and 17 and preferably has a roller 66 on the end thereof whereby the weight of the arms 65 and roller 66 retain the side wall blank in frictional engagement with the belts 42. As sidewall blank 7 moves forward to the end of belts 42, it is guided between bars 52 and 53 by fixed rollers 73 attached to bar 52. As best seen in FIG. 4, one or more idler pulleys can be mounted on the support 5 to help adjust slack out of the chain 36. Idlers 67 are each rotatably mounted on a respective arm 68 which in turn is secured to a portion of the support 5 in a manner so that same can be easily adjusted.

The feeding means 2 is provided with means for selectively allowing feed or no feed operation. In the illustrated structure, as best seen in FIGS. 1 and 3, this means includes an arm 70 pivotally mounted on the shaft 23. The arm has a portion 71 with a roller 72 mounted thereon which is selectively engageable with the top blank 7 on the stack 8. The arm has a second portion 74 which in turn is connected to an extendable and retractable ram 75 which selectively effects pivoting movement of the arm 70 on the shaft 23. The ram 75 preferably is mounted on the support 5 as, for example, a clevis mount 76 pivotally secured to a bracket 77. The rod portion of the ram 75 is then pivotally connected to the portion 74. Extension of the ram moves the arm 71 downwardly and the roller 72 into engagement with the top blank thereby elevating shaft 23 and the first and second arm means 9 and 10 so that the friction member 27 is out of feed engagement with the top blank 7 of the stack 8. Retraction of the ram 75 moves the roller 72 out of engagement with the top blank 7 thereby allowing feeding engagement between the friction member 27 and a blank 7. By regulating the pressure on the retraction side of the ram 75, a force adjustment can be accomplished to adjust the force applied to the top blank 7 by the friction member 27.

In a preferred embodiment of the present invention the storage magazine 3 is as described below. The magazine 3 includes a framework 85 which includes cross braces 86, 87, 88 and 89 and a plurality of upstanding supports 90. The framework 85 can be made of any suitable material such as structural angles. Plates 91, 92, and 93 can be secured to the braces 86, 88, and 89, respectively. A pair of wall forming members 94 and 95 are secured in the framework 85 in a suitable manner and, as shown, extend between the plates 91 and 92 and are suitably secured thereto. The walls 94 and 95 are spaced apart and positioned relative to one another to receive a stack 8 of blanks 7 therein and form a generally vertically positioned stack wherein the walls 94 and 95 prevent lateral movement of the blanks. Preferably, a portion 96 of the wall 94 is hinged relation to the remainder of the wall 94 so that same can be moved between open and closed positions to facilitate loading of blanks. A suitable lock 98 selectively prevents movement of the portion 96 about the hinge 97.

The storage magazine 3 includes two elevator means 100 and 101 which are in generally vertical alignment relative to one another with the elevator 100 being a lower elevator and the elevator 101 being an upper disposed elevator. The elevator means 100 and 101 cooperate with one another in a manner described below. Although several modes of operating cooperation can be accomplished, a preferred mode is that blanks are fed from the stack supported by the elevator means 100 until a predetermined up position is reached by the elevator 100 at which time the elevator means 101 continues to feed the blanks to the feeding means 2 while the elevator means 100 is returning to a fill position for replenishment of the supply of blanks. Upon replenishment the elevator means 100 is actuated and moves upwardly and at a predetermined up position a portion of the elevator means 101 is actuated allowing a portion of the stack carried by the elevator means 101 to join the stack of blanks carried by the elevator 100 at which point the elevator 100 continues upward movement for feeding of blanks to the feeding means 2. This will cause a minimum of missed feeds thereby still resulting in an efficient feeding means 2.

In the illustrated structure the elevator means 100 includes a platform 102 which is movably mounted in the framework 85 as, for example, by having a brace or support 103 secured thereto and means for selectively effecting reciprocating vertical movement thereof. As shown, the support 103 is movably mounted on a guide or slide 104 wherein rollers 105 and 106, which are rotatably mounted on a portion of the support, engage the slide 104. The rollers 105 are spaced from the roller 106 a distance sufficient to stabilize the support 103 during movement. An opening 107 is provided in the wall member 95 and provides a clearance for a portion of the support 103 extending through the opening 107 so that the support 103 and platform 102 can move therein vertically. Power means is provided to cooperate with the support 103 to effect movement thereof and, as shown, the power means includes an extendable and retractable pneumatic ram 109 which preferably is double acting and is mounted on the framework 85. The ram 109 has a rod portion 110 thereof engageable with an upstanding portion 111 of the support 103 whereby extension and retraction of the ram 109 effects vertical movement of the platform 102 and support 103 and is guided by the roller and slide arrangement. Preferably, the platform 102 is shaped similar to the shape of the blanks 7 carried thereby and as shown has a pair of opposed cutouts 112 and 113 for a purpose to be later described. The cutouts 112 and 113 are sized and positioned so that a portion of the blanks 7 extends over each of the cutouts.

Figure 7:
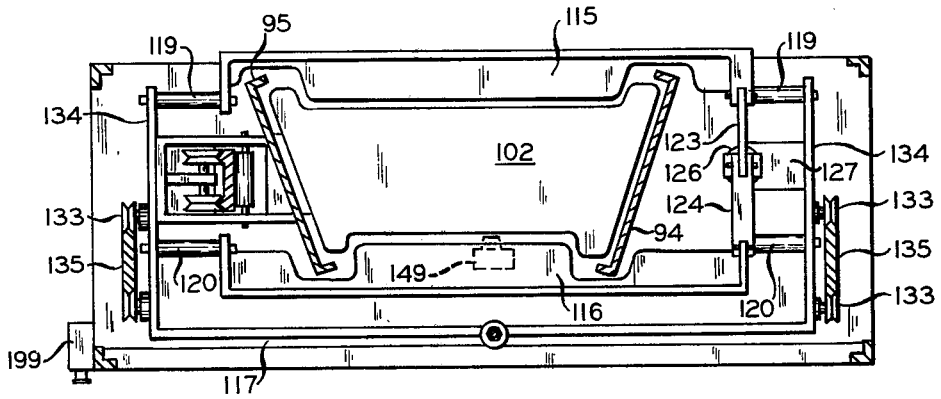
FIG. 7 is a sectional view of the magazine taken along the line 7—7, FIG. 6.
Figure 8:
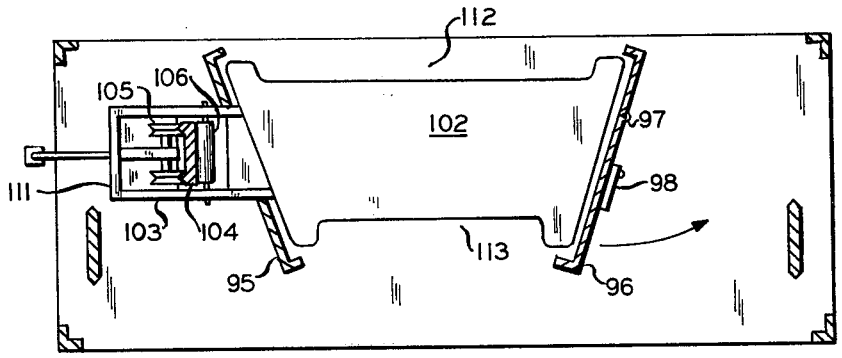
FIG. 8 is a sectional view of the magazine taken along the line 8—8, FIG. 6.

The elevator means 101 is best seen in FIG. 7 and is positioned generally above the elevator means 100. In the illustrated structure the elevator means 101 includes a pair of jaws 115 and 116 mounted on a carriage 117. The jaws are shaped and positioned so as to have portions received within respective cutouts 112 and 113 and are adapted to be selectively moved from an expanded position to a retracted position, i.e., within the respective cutouts 112 and 113 so as to be under a portion of blanks carried by the platform 102. In the illustrated structure the carriage 117 has the jaws 115 and 116 pivotally mounted thereon as by pivots 119 and 120, respectively. Any suitable type of pivot can be used. The means for moving the jaws 115 and 116 between the expanded and retracted positions is best seen in FIG. 5 and is shown partially in broken lines as same is hidden behind a portion of the carriage 117. The jaws 115 and 116 each have an arm portion 121 and 122, respectively. Links 123 and 124 are pivotally connected to the respective arms 121 and 122 in any suitable manner with each of the links having an end portion thereof pivotally connected to each other as at 125. Power means is provided to effect operation of the jaws 115 and 116 and, as shown, a pneumatic ram 126 is carried or mounted on a portion of the carriage 117 as by a bracket 127 with the ram having the movable rod portion 128 thereby pivotally connected to the links 123 and 124 at the pivot 125 as by a clevis 129. Retraction of the ram 126 will effect expansion of the jaws 115 and 116 and extension of the ram 126 will effect retraction of the jaws 115 and 116 to the position as shown in FIG. 5. The jaws 115 and 116 form a platform on which a stack of blanks 7 can be supported for upward movement to the feed means 2.

Means is provided to effect vertical reciprocal movement of the elevator means 101 in general axial alignment with movement of the elevator means 100. It is to be understood that any suitable means can be employed. In a preferred embodiment power means is provided to effect the reciprocating movement of the elevator means 101 and preferably the power means is a selectively extendable and retractable pneumatic ram 131 which is secured to the framework 85. The movable rod portion 132 of the ram 131 is secured to the carriage 117 whereby extension and retraction of the ram will vertically move the elevator means 101 downwardly and upwardly, respectively. In order to guide the movement of the elevator means 101 suitable guide means is provided to cooperate with the carriage 117. As shown, the guide means include a pair of rollers 133 secured to each side plate 134 of the carriage 117. A slide or guide member 135 is secured to the framework 85 adjacent opposite sides thereof and is in engagement with a respective pair of rollers 133 to effect the guiding.

Figure 6:
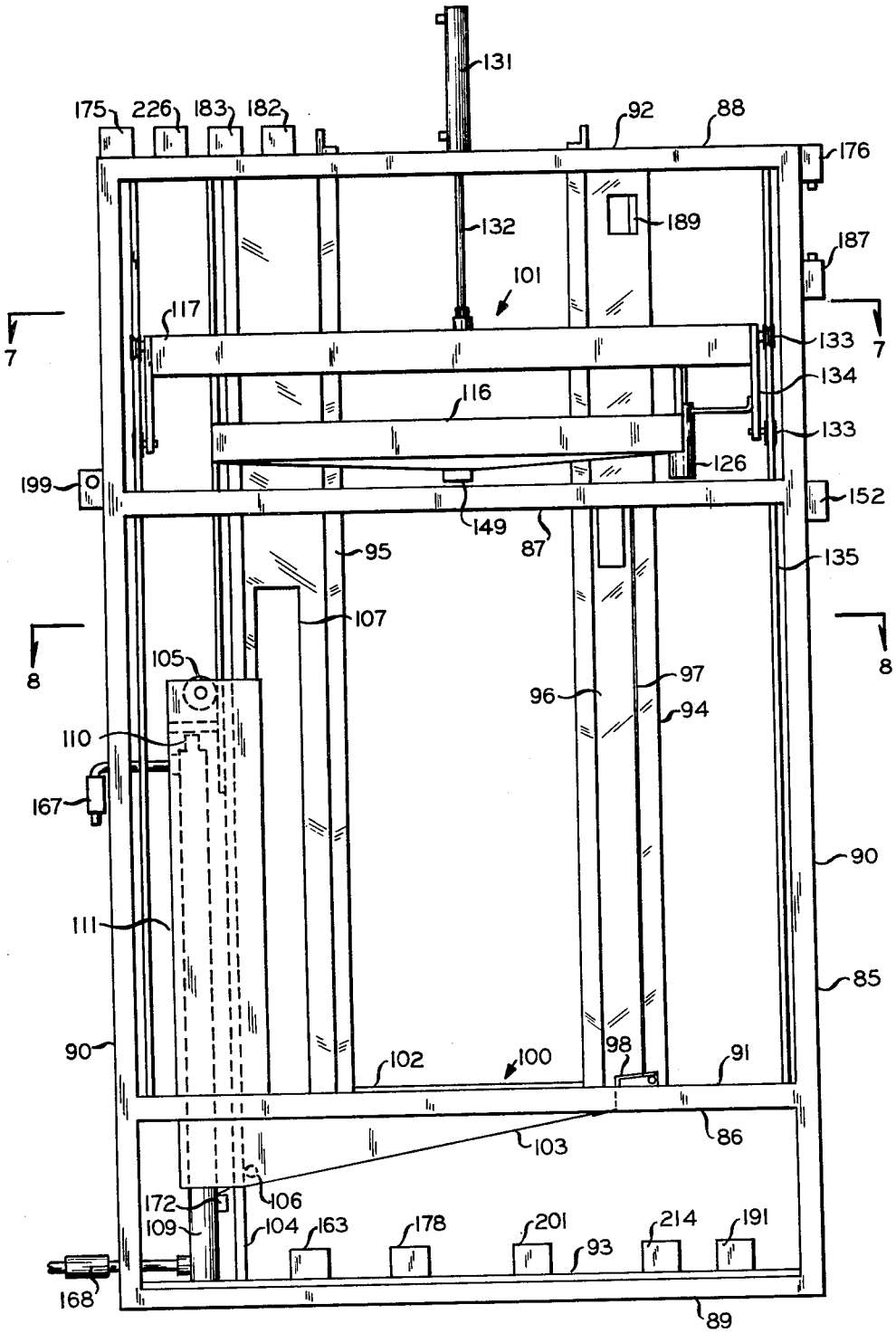
FIG. 6 is a front elevational view of the storage magazine.

In order to control the various movements of the components of the storage magazine 3 a control system is provided. The following control system is a preferred form, however, it is to be understood that other arrangements of components can be made and still provide an adequately operable storage magazine 3. If a different operating procedure is desired, minor variations can be made in the below-described control system to accomplish the different operations. The control system described below operates the storage magazine 3 in the following manner with the elevator means 101 being empty and the apparatus 1 ready for operation. A stack of blanks 7 is loaded onto the platform 102 when same is in the down position as seen in FIG. 6. The elevator means 100 is actuated wherein the stack thereon moves upwardly and when the top blank reaches a position suitable for engagement with the friction member 27 feeding of blanks commences. At a predetermined position of the platform 102, the jaws 115 and 116 move to a closed or retracted position, as seen in FIG. 5, whereby the elevator means 101 continues to move the stack upwardly so that blanks can be fed therefrom by the feeding means 2. The elevator means 100 can then be lowered for refilling. After same reaches the bottom a new stack of blanks can be loaded on the platform 102 after which platform 102 can be actuated to move upwardly and at a predetermined position the jaws 115 and 116 will be actuated and move to an extended position whereby the stack remaining thereon will join the top of the stack resting on the platform 102 whereby the platform 102 continues upward movement for maintaining a blank in a feeding position adjacent the friction member 27. The above-described process will be repeated when the platform 102 reaches a predetermined up position as described above.

Figure 9:
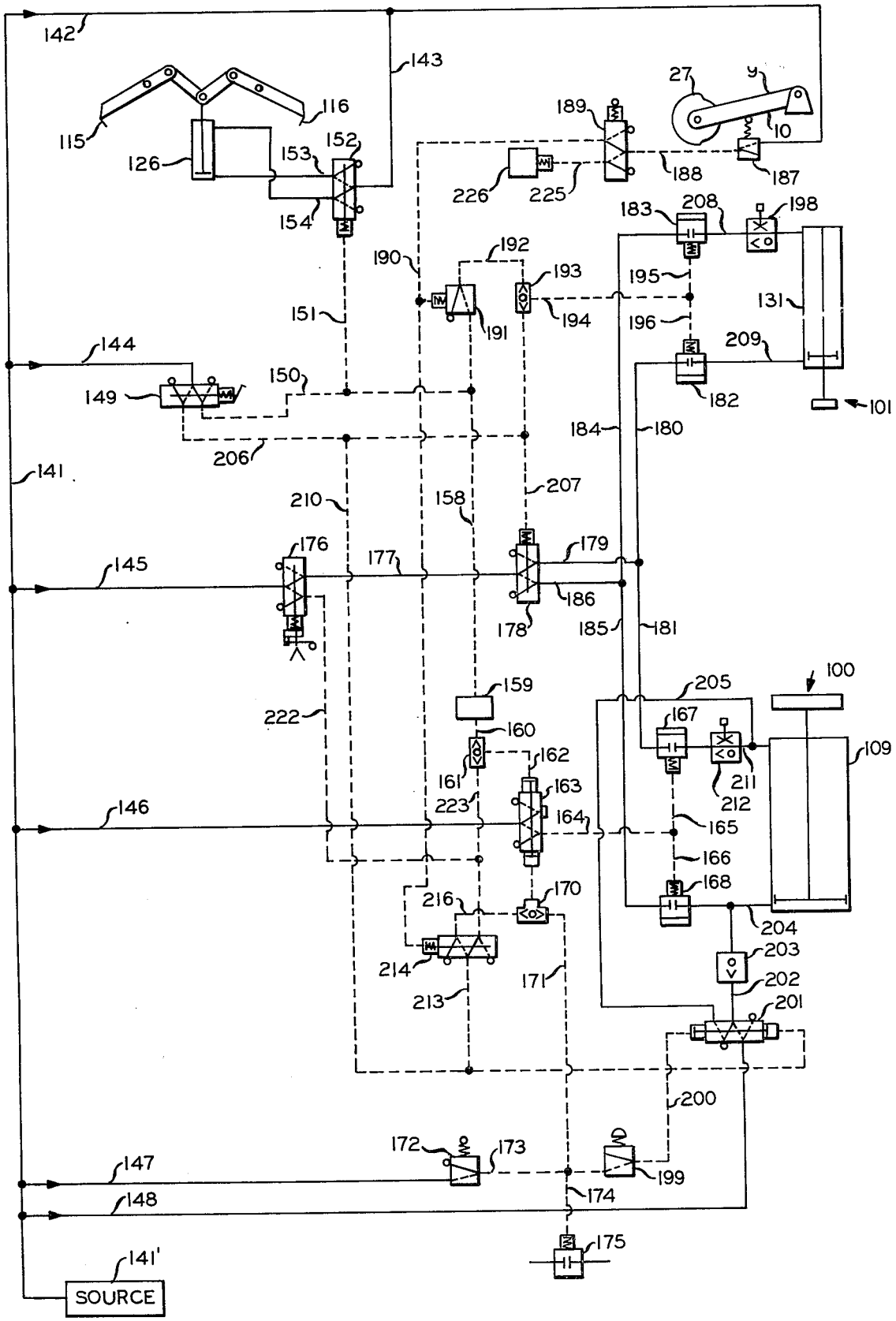
FIG. 9 is a schematic diagram of the control system used to control the operation of the various parts of the magazine.

The control system for the elevator means 100 and 101 preferably is comprised of pneumatic controls for activating the various component parts in the proper sequence. In the illustrated control system, a main supply line 141 is connected to a suitable source of pressurized air 141'. A plurality of branch lines 142, 143, 144, 145, 146, 147 and 148 are all connected to the line 141 and are adapted for providing pressurized air to various portions of the control system. All component parts of the control system of FIG. 9 are shown schematically in their normally unactuated mode and broken lines indicate pilot air lines. The locations of the control components are best seen in FIGS. 5 and 6. In the description of the control system the parts and their various functions will be described simultaneously for purposes of clarity. When pressurized air is supplied to the line 141 and the branch lines pressurized air is supplied to a four-way valve 149 through the line 144. A line 150 is connected to one port of the valve 149 and there is also connected to the line 150 a line 151 which in turn connects the line 150 to the pilot of a valve 152 which is a four-way valve. When pressurized air is supplied to the valve 152 from the line 151 this pilot actuated valve will shift allowing air to flow from the pressure line 143 through the valve into the line 153, that is connected to valve 152, and then to the ram 126. A line 154 connects the other side of the ram 126 to another port of the valve 152. When the valve is in the shifted position, the line 154 acts as a vent line for venting of air from one side of the ram through the valve 152. This would effect extension of the ram 126. Shifting of the valve 152 in the opposite direction would reverse operation of the ram 126 wherein venting would be accomplished through the line 153 and the valve 152. Extension of the ram 126 will effect movement of the jaws 115 and 116 to their retracted or closed position for supporting a stack of side walls. Pressurized air in the line 150 is also supplied to a line 158 which is connected thereto and to the pulse valve 159, the line 160, a shuttle valve 161 which will then provide pilot air through a line 162 to the pilot of a pilot-operated four-way valve 163 which will shift under the influence of the pilot air. The pulse valve 159 is for the purpose of momentarily shifting valve 163. When the valve 163 shifts, air supplied from the line 146 to the lines 164, 165 and 166 for pilot operators. The lines 165 and 166 are connected to pilots of pilot-operated two-way valves 167 and 168, respectively. The valves 167 and 168 are normally closed whereby when air is supplied through the lines 165 and 166 same move to an open position so that the ram 109 can return to its lower or retracted position. When the ram 109 moves to its retracted position, the bottom portion of the support 103 (see FIG. 6) contacts an actuating lever of a three-way valve 172 to move the valve 172 to an open position whereby pressurized air can be supplied from the line 147 through the valve 172 to a line 173 and also a line 174 which is connected to normally open pressure switch 175 which can be operably connected to a light or alarm for activation of same to tell an operator that the lower elevator 100 has the platform 102 in a position ready for filling or reloading. The line 171 is also connected to the line 173 for supplying air to a shuttle valve 170 which is connected to the valve 163 to return it to its original position.

A four-way valve 176 is connected in the line 145 and has a line 177 connected to one port of the valve 176 and a port of the four-way valve 178. A line 179 is connected to the valve 178 and has lines 180 and 181 connected thereto with the line 181 being connected to the valve 167 and the line 180 being connected to a normally closed two-way valve 182. Lines 184 and 185 are also connected to the valve 178 via a line 186. The lines 184 and 185 are also connected to valves 183 and 168, respectively, with the valves 183 and 168 preferably being two-way normally closed pilot-operated valves. Pressurized air flows through the valves 182 and 167 as supplied from the valve 178 which in turn is supplied from the valve 176 in the line 145. At this time, valves 183 and 168 are vented through the lines 184, 185 and 186 whereby with pressurized air being supplied to the normally closed valves 182 and 167 the ram 109 is urged into its retracted position and the ram 131 is urged to its extended position whereby both of the elevator means 100 and 101 are in their lower position.

Three-way valve 187 is moved to a open position if the first and second arm means 9 and 10 are in position for feeding side walls. If so, pilot air is fed through the valve 187, the line 188, a four-way valve 189 and a line 190 providing pilot air to shift three-way valve 191 to an open position thereby providing pilot air from line 150 through the valve 191 through line 192, shuttle valve 193 into lines 194, 195 and 196 to thereby move valves 183 and 182 to an open position. Since valve 182 is on the pressure side of the ram 131, and the valve 183 is in a vent position on the vent side of the ram 131, the ram 131 begins to retract with its feed being controlled by a throttle valve 198 which is connected in a line 208 between the ram 131 and valve 183. Retraction of the ram 131 positions side walls for feeding by moving same into engagement with the friction member 27.

As soon as the bottom elevator platform 102 has been reloaded by the operator, the valve 172 being closed by engagement with the platform 102 when same is in the down position, the operator can manually depress a three-way push-button valve 199 to initiate a quick lift by supplying pilot air through a line 200 to a pilot of a four-way valve 201. Pilot air shifts the valve so that pressurized air supplied from the line 148 through the valve 201 into a line 202 through a check valve 203 and into a line 204 which is connected one side of the ram 109. The line 204 also connects the valve 168 to the ram 109. This starts the lift of the platform 102 and air is vented from the other side of the ram 109 via a line 205 which is connected to a line 211 which is connected to the ram 109. The line 205 is also connected to the valve 201, so that when same is shifted for lifting of the ram 109, venting of the opposite side of the ram 109 can be accomplished through the valve 201 permitting full speed movement of the ram 109 to an extended position. When the top of the stack of side walls contained on the lower platform 102 reaches and depresses a lever arm of the valve 149, the valve 149 preferably being mounted on the jaw member 116, the valve is shifted to provide pilot air through the lines 206 and 207, the shuttle valve 193 and lines 194, 195, and 196 to open the valves 183 and 182 allowing the valve 182 to vent the arm 131 via line 209 which connects the valve 182 to one side of the ram 131. The line 208 connects the valve 183 to the ram 131 through the valve 198 and pressurized air is supplied through the valve 178 to the valve 183 which are open with the valve 178 being shifted by pilot air supplied through the line 207. This allows pressurized air to flow into one side of the ram 131 to effect extension thereof which effects downward movement of the upper elevator means 101. Since the valve 152 is a spring return valve, the shift of the valve 149 as described above allows pilot air to flow into lines 150 and 151 wherein the valve 152 is shifted so that pressurized air is supplied to the ram 126 so same is retracted and thereby move the jaws 115 and 116 to their open position whereby the stack of side walls which were supported thereby move downwardly and join the stack of side walls carried by the lower elevator means 100.

A pilot line 210 is connected to the line 206 and also a pilot connection of the valve 201. When pilot air is supplied through the lines 206 and 210, when the valve 149 is shifted, the valve 201 is reshifted to the position shown so that the air contained in the rod side of the ram 109 cannot be vented through the line 205 but vents through the line 211 and an adjustable throttle valve 212 connected in the line 211. The air is also vented from the line 211 through the valve 167 and the valve 178 which has shifted due to pilot air being supplied from lines 206 and 207. This allows control of the upward movement speed of the ram 109. While this upward movement is taking place, the ram 131 automatically moves to a wait position, i.e., a fully extended position. As the combined stack of side walls moves upward via extension of the ram 109, the limit valve 187 is closed thereby providing pilot air through the line 188, the valve 189 and the line 190 to a four-way valve 214 wherein the pilot air shifts the valve 214. A line 213 connects the valve 214 to the pilot line 210 and when the valve 214 is shifted, pilot air from the line 213 is supplied therethrough via a line 216 to the shuttle valve 170 to effect shifting of the valve 163 which in turn provides pilot air through the line 164 to the lines 165 and 166 and thereby shift the valves 167 and 168 to their open positions. This will effect upward movement of the lower elevator means 109 in response to the signal generated by the feeding means actuating the valve 187 when the stack becomes too low for feeding whereby the ram 109 moves upwardly to move the stack of blanks into a feeding position. As the elevator means 100 moves upwardly, the bottom of the stack of side walls moves past an actuating lever arm of the valve 149 allowing the lever to move outward thereby shifting the valve 149 so as to provide pilot air via the lines 150 and 151 to shift the valve 152 so as to provide pressurized air from the line 143 through the line 153 so as to extend the ram 126 and move the jaws 115 and 116 inwardly and under the stack of blanks and into the cutouts 112 and 113. When this is accomplished the ram 131 has the valves controlling same shifted as described above so that same is in an operating mode for retraction thereby raising the upper elevator means 101 to move the stack of blanks supported by the jaws 115 and 116 upwardly for feeding. Also, as described above, when the ram 131 begins to retract the ram 109 is placed in an operational mode for retraction thereby lowering the lower elevator means 100. When same reaches the down position the valve 172 is moved to an open position and sets off the alarm as controlled by the valve 175 as described above signaling that the lower elevator means 100 needs reloading.

The valve 176 and the valve 187 are activated or operated by movement of the arm means 9 and 10 wherein the link 21 connecting same, as shown, has an abutment member 221 secured thereto whereby if the upper and/or lower elevator means moves too far upwardly, the lever arm of the valve 176 will be contacted momentarily shifting valve 176 to provide pilot air through a line 222 through the valve 214, line 213 and thereby shift the valve 201 to thereby effect lowering of the lower elevator if it is in a lift operating mode. Operation of the valve also supplies pilot air through the line 222 to the line 223 through the shuttle valve 161, the line 162 in order to shift valve 163 so as to effect movement of the valves 167 and 168 to their open positions so that the valve 168 is open to vent causing the elevator to move downward in a short pulse. If the upper elevator means 101 is the one moving the stack of blanks rather than the ram 109, the valve 182 is vented momentarily through the valve 178, the line 177 and the valve 176 thereby allowing the ram 131 to momentarily move downwardly in a pulse until the lever arm of the valve 176 is no longer contacted by the feeding means 2.

If the arm means 9 and 10 drops to a position to contact the valve 187 in which event the stack of blanks is too low for a proper feeding, valve 187 is shifted to an open position thereby allowing pilot air to flow through the valve 189 to the valves 191 and 214 to shift same to their original position momentarily. If the ram 109 is in an operational mode and pressurized air is applied through the valve 168 thereto to allow the ram 109 to be momentarily supplied with pressurized air to extend the ram 109 wherein same is raised until the valve 187 is moved to a closed position. If the ram 131 is in an operational mode, the valve 182 has pressurized air supplied therethrough to retract the ram and raise the elevator until the valve 187 is moved to its closed position. In any event, the supply of side walls during upward movement of the upper elevator diminishes until the upper elevator 101 contacts the lever arm of the valve 189 which is mounted on wall 94 wherein same is shifted to provide pilot air from line 142 through the valve 187, line 188 and into a line 225 which is connected between the valve 189 and normally closed pressure switch 226 to open an electrical circuit which is operably connected to the side wall and disc feeders of the package-forming machine to turn same off.

It is to be understood that while I have illustrated and described certain forms of my invention, it is not to be limited to the specific form or arrangement of parts herein described and shown except to the extent that such limitations are found in the claims.

What is claimed and desired to be secured by Letters Patent is:

1. An apparatus for feeding side wall blanks from a source to a point of use, said apparatus including:

(a) a support member;

(b) a first arm means pivotally mounted on said support member and having a free end;

(c) a second arm means pivotally mounted on said support member and spaced from said first arm means and having a free end;

(d) a first member pivotally connected to said first arm means and second arm means adjacent the respective free ends;

(e) a feed member mounted on said first arm means and movable with said first arm means, said feed member having a portion spaced from a portion of said first member forming a side wall blank receiving throat therebetween, first drive means, said feed member being operably connected to said first drive means for having operation effected by said first drive means;

(f) conveying means positioned adjacent said feed member and being operable for conveying to a point of use a side wall blank fed by the feed member through the throat, second drive means, said conveying means being operably connected to said second drive means for having operation effected by said second drive means.

2. An apparatus as set forth in claim 1 wherein:

(a) the first arm means, second arm means, first member and support member are pivotally connected to one another to form at least a four link linkage arrangement whereby said first arm means, second arm means, first member and support member can pivotally move relative to one another.

3. An apparatus as set forth in claim 2 including:

(a) first stop means cooperating with at least one of the first and second arm means limiting the pivoting movement thereof; and wherein (b) said first member throat forming portion remaining at substantially the same angle relative to a fixed plane throughout pivoting movement of the first and second arm means.

4. An apparatus as set forth in claim 2 wherein:

(a) said feed member includes a rotatable wheel operably connected to said first drive means for rotation thereby, said wheel having a recessed peripheral portion.

5. An apparatus as set forth in claim 2 wherein said conveying means includes:

(a) third drive means, a second member movably carried by said first arm means and operably connected to said third drive means for having movement effected by said third drive means, said second member having a plurality of projections thereon forming abutments engageable with a respective leading edge of a side wall blank being carried by the conveying means;

(b) fourth drive means, a friction member movably carried by said second arm means and operably connected to said fourth drive means for having movement effected by said fourth drive means, said friction member being movable at speed greater than that of the projections, said friction member being engageable with a first surface of a side wall blank; and (c) first means positioned adjacent the friction member and adapted for engaging a second surface of the side wall blank and urging the first surface into frictional engagement with the friction member.

6. An apparatus as set forth in claim 5 wherein said conveying means includes:

(a) a pair of spaced apart shoulder members;

(b) a carriage reciprocally movably mounted on said support and operably connected to means for effecting the reciprocal movement of the carriage, said shoulder members are movably mounted on said carriage, said reciprocal movement being generally in the same direction as the movement of the side wall blank with the friction member; and (c) second means operably connected to said shoulder members, for selectively effecting movement of said shoulder members relative to the carriage in a direction generally normal to the direction of movement of the carriage.

7. An apparatus as set forth in claim 4 wherein:

(a) said wheel is positioned above the first member throat forming portion whereby said apparatus is adapted to feed a side wall blank from the top of a stack of side wall blanks.

8. An apparatus as set forth in claim 7 including:

(a) third means cooperating with said first and second arm means and said first member for counterbalancing said first and second arm means and said first member.

9. An apparatus as set forth in claim 7 including:

(a) an arm pivotally mounted on said first arm means adjacent said wheel and having a portion adapted to engage a side wall blank on top of a stack of side wall blanks; and (b) fourth means connected to said arm and being operable for effecting pivoting movement of said arm and selective engagement of the arm with a side wall blank.

10. An apparatus as set forth in claim 7 including:

(a) magazine means positioned adjacent to said wheel and being adapted for storing a plurality of side wall blanks in a stack under said wheel, said magazine means including an elevator means movable toward said wheel and including control means operable for controlling movement of said elevator means.

11. An apparatus for feeding side wall blanks to a point of use, said apparatus including:

(a) a first support member;

(b) a first arm means pivotally mounted on said first support member and having a free end;

(c) a second arm means pivotally mounted on said first support member and spaced from said fist arm means and having a free end;

(d) a first member pivotally connected to said first arm means and second arm means adjacent the respective free ends;

(e) a feed member mounted on said first arm means and movable with said first arm means, said feed member having a portion spaced from a portion of said first member forming a side wall blank receiving throat therebetween, said feed member being operably connected to first drive means for having operation effected by said first drive means;

(f) conveying means positioned adjacent said feed member and being operable for conveying to a point of use a side wall blank fed by the feed member through the throat, said conveying means being operably connected to second drive means for having operation effected by said second drive means;

(g) a second support;

(h) a first elevator means movably mounted on said second support and selectively movable between first and second positions;

(i) first power means cooperating with said first elevator means and being operable for moving the first elevator means between said first and second positions;

(j) a second elevator means positioned adjacent to and in line with the first elevator means, said second elevator means including jaw means movable between an open position and closed position, said second elevator means being movably mounted on said second support and being movable between third and fourth positions coaxially with the axis of movement of the first elevator means;

(k) second power means cooperating with said second elevator means and being operable for moving said second elevator means between said third and fourth positions; and (l) control means associated with said first and second elevator means and said first and second power means for controlling operations thereof.

12. An apparatus as set forth in claim 11 wherein:

(a) the first arm means, second arm means, first member and first support member are pivotally connected to one another to form at least a four link linkage arrangement whereby said first arm means, second arm means, first member and support member can pivotally move relative to one another.

13. An apparatus as set forth in claim 12 including:

(a) first stop means cooperating with at least one of the first and second arm means limiting the pivoting movement thereof; and wherein (b) said first member throat forming portion remains at substantially the same angle relative to a fixed plane throughout pivoting movement of the first and second arm means.

14. An apparatus as set forth in claim 13 wherein:

(a) said feed member includes a rotatable wheel operably connected to said first drive means for rotation thereby, said wheel having a recessed peripheral portion.

15. An apparatus as set forth in claim 11 wherein:

(a) said control means includes a first sensor positioned for actuation by a portion of the first elevator means when said first elevator means is adjacent the second position, said first sensor is operably connected to said second power means, said jaw means and said first power means whereby upon actuation of the first sensor, said jaw means moves from an open position to a closed position, said second elevator means begins movement from the third position toward said fourth position by operation of the second power means, and said first elevator means begins movement from the second position toward the first position by operation of the first power means.

16. An apparatus as set forth in claim 15 wherein:

(a) said control means includes a second sensor operably connected to said first power means and is actuatable when said first elevator means is in said first position whereby upon actuation of said second sensor, said first power means moves said first elevator means toward said second position to actuate said first sensor whereby upon actuation of the first sensor said second elevator means moves toward said third position and said jaw means moves to an open position.

17. An apparatus for storing and supplying side wall blanks to a feed means, said apparatus including:

(a) a support;

(b) first elevator means movably mounted on said support and selectively movable between first and second positions;

(c) first power means cooperating with said first elevator means and being operable for moving the first elevator means between said first and second positions;

(d) second elevator means positioned adjacent to and in line with the first elevator means, said second elevator means including a carriage, a plurality of jaw members pivotally mounted on said carriage, and third power means operably connected to said jaw members for selectively pivotally moving the jaw members between an open position and a closed position, said jaw members forming an article supporting platform when in the closed position, said second elevator means being movably mounted on said support and being movable between third and fourth positions coaxially with the axis of movement of the first elevator means;

(e) second power means cooperating with said second elevator means and being operable for moving said second elevator means between said third and fourth positions; and (f) control means associated with said first and second elevator means and first and second power means for controlling operations thereof, said control means including a first sensor mounted on and movable with said second elevator means and positioned for actuation by a portion of the first elevator means when said first elevator means is adjacent the second position, said first sensor being operably connected to said second power means, said third power means and said first power means whereby upon actuation of the first sensor, said jaw members move from an open position to a closed position, said second elevator means begins movement from the third position toward said fourth position by operation of the second power means, and said first elevator means begins movement from the second position toward the first position by operation of the first power means; said control means further including a second sensor operably connected to said first power means and actuatable when said first elevator means is in said first position whereby upon actuation of said second sensor, said first power means moves said first elevator means toward said second position to actuate said first sensor whereby upon actuation of the first sensor said second elevator means moves toward said third position and said jaw members move to an open position.

18. An apparatus as set forth in claim 17 wherein:

(a) said second sensor is a manually operated type.

19. An apparatus as set forth in claim 17 wherein:

(a) said first, second and third power means includes first, second and third extendable and retractable fluid rams respectively, said first and second rams are each operably connected to a respective first and second elevator means.

20. The apparatus as set forth in claim 17 wherein:

(a) said control means includes feedstack sensing means including a first feedstack position sensor and a second feedstack position sensor operably connected to said first power means and to said second power means to maintain feedstack elevation within a range of elevations determined by said first and second feedstack sensors.

21. An apparatus for storing and supplying side wall blanks to a feed means, said apparatus including:

(a) a support;

(b) first elevator means movably mounted on said support and selectively movable between first and second positions;

(c) first power means cooperating with said first elevator means and being operable for moving the first elevator means between said first and second positions;

(d) second elevator means positioned adjacent to and in line with the first elevator means, said second elevator means including a carriage, a plurality of jaw members pivotally mounted on said carriage, and third power means operably connected to said jaw members for selectively pivotally moving the jaw members between an open position and a closed position, said jaw members forming an article supporting platform when in the closed position, said second elevator means being movably mounted on said support and being movable between third and fourth positions coaxially with the axis of movement of the first elevator means;

(e) second power means cooperating with said second elevator means and being operable for moving said second elevator means between said third and fourth positions;

(f) control means associated with said first and second elevator means and said first and second power means for controlling operations thereof; and (g) storage means including a first member mounted on said support and extending between at least about said first and fourth positions and positioned adjacent one side of said first and second elevator means, and a second member mounted on said support and extending between at least about said first and fourth positions and positioned adjacent a side opposite said one side of said first and second elevator means, said first and second members cooperating to form a side wall blank storage magazine.

22. An apparatus as set forth in claim 21 wherein:

(a) said second member has a selectively movable portion operable for selectively providing an enlarged entry for facilitating loading of side wall blanks onto the first elevator means.

* * * * *